United States Patent [19]

Mendenhall et al.

[11] Patent Number: 4,614,141

[45] Date of Patent: Sep. 30, 1986

[54] FOOD PRODUCT CENTERING AND ALIGNING TUBE

[76] Inventors: George A. Mendenhall, 2800 Tartan Pl., Boise, Id. 83702; Scott K. Carter, 4401 Goldenrod, Meridian, Id. 83642

[21] Appl. No.: 744,244

[22] Filed: Jun. 13, 1985

[51] Int. Cl.[4] ..... B26D 1/03

[52] U.S. Cl. ..... 83/402; 83/98; 83/404.3; 99/538; 99/545

[58] Field of Search ..... 99/589, 536, 516, 584, 99/586, 537, 538, 567, 543, 545; 83/402, 24, 98, 403, 404.3; 426/482, 518, 520

[56] References Cited

U.S. PATENT DOCUMENTS

| | | | |
|---|---|---|---|
| 3,024,821 | 3/1962 | Bean | 99/586 |
| 3,108,625 | 10/1963 | Lamb et al. | 83/402 |
| 3,109,468 | 11/1963 | Lamb et al. . | |
| 3,116,772 | 1/1964 | Lamb et al. . | |
| 3,366,151 | 1/1968 | Barrett . | |
| 4,082,024 | 4/1978 | Hodges et al. | 83/98 X |
| 4,135,002 | 1/1979 | Hodges et al. | 426/482 |
| 4,372,184 | 2/1983 | Fisher et al. | 83/98 |
| 4,423,652 | 1/1984 | Winslow . | |

*Primary Examiner*—Timothy F. Simone
*Attorney, Agent, or Firm*—Paul F. Horton

[57] ABSTRACT

A centering and aligning tube for use in hydraulic food cutting apparatus, said tube including a rigid outer housing and a resilient liner insertable into the housing, the liner constructed of resilient material and preferably provided with a plurality of evenly spaced, radially inward and longitudinally extending ribs operable to engage the food product, such as a potato, for alignment and centering thereof relative to a cutter. The ribs are preferably tapered from entrance to a location adjacent the exit of the liner. A resilient annular seal with an opening for passage of the food product, such as a raw potato, is provided adjacent the exit end of the liner to increase the exit speed of the potato and to restrict fluid use for greater efficiency. An inner tube engaging the inner most surface of the ribs may optionally be provided.

21 Claims, 6 Drawing Figures

FOOD PRODUCT CENTERING AND ALIGNING TUBE

BACKGROUND OF THE INVENTION

1. Field of the Invention

This invention relates generally to hydraulic food cutting apparatus and, more particularly to an improved tube for aligning and centering raw potatoes relative to the cutter.

2. Description of the Prior Art

Hydraulic feed product cutting apparatus, as typified by U.S. Pat. Nos. 3,108,625 and 3,109,468 issued to F. G. Lamb et al; 4,082,024 issued to J. L. Hodges et al; and W. I. Fisher et al, is old in the art. Such devices are operable to hydraulically propel raw food products such as potatoes into a cutter for slicing the potato into strips of desired shape for the production of french fries or the like.

It is important for quality production and efficiency that the raw food product be properly aligned and centered upon contact with the cutter blades. For potatoes, which are often oblong in shape, it is important that the potato enter the cutter in a lengthwise position rather than a crosswise position to obtain longer fries and to maximize use of the potato.

To prevent the tumbling of potatoes and to assist in alignment and centering, a number of devices have been created. U.S. Pat. No. 3,108,625 utilizes mechanical guides impacting upon a resilient tube to perform the function, as does U.S. Pat. No. 3,109,468. U.S. Pat. Nos. 4,082,024 and 4,135,002 utilize moveable walls to perform the function. Such devices are expensive, require periodic maintenance and restrict production by "down time" due to repairs and due to their slow reaction time. In an effort to align and center without mechanical walls, shoes, guides, and the like, U.S. Pat. No. 4,423,652 simply utilizes an elongated uninterrupted tube having a progressively decreasing cross-sectional flow area. Such a tube relies completely upon hydraulic forces and obviously must be of such diameter to accommodate the largest of potatoes. In enlarging the diameter there is an inherent problem of tumbling of smaller potatoes which may strike a sidewall setting up turbulence in the water mass and a vibration in the course of the potato.

The present invention overcomes these problems found in the prior art by providing an improved alignment and centering tube which does not utilize mechanized positioners or guides but rather utilizes resilient material, preferably in rib form, for engaging the potato or other raw food product for the alignment and centering thereof.

SUMMARY OF THE INVENTION

The present invention comprises, generally, a potato centering and alignment tube having a rigid outer housing and a liner made of resilient material, said liner preferably provided with a plurality of inwardly, radially and longitudinally extending resilient ribs for engagement with the potato to align and center the potato. A seal, adjacent the outlet port of the liner greatly increases hydraulic pressure on the potato to accelerate the potato immediately before it enters the cutter. An inner tube in engagement with the ribs is optional. A more thorough and comprehensive description may be found in the appended claims.

It is therefore a primary object of the present invention to provide in an hydraulic potato cutting assembly a food product centering and aligning tube having a rigid outer housing and a resilient liner operable to engage the potato for centering and aligning thereof.

More specifically, it is an object of the present invention to provide in an hydraulic potato cutting assembly, a tube having a plurality of inwardly radially and longitudinally extending resilient ribs for alignment and centering of potatoes entering the cutter.

It is also an object of the present invention to provide a centering and aligning tube which includes a resilient seal, having an opening for potato passage, adjacent the cutter for accelerating the potato as it enters the cutter.

Additional objects and advantages will become apparent and a more thorough and comprehensive understanding may be had from the following description forming a part of this specification.

DETAILED DESCRIPTION OF THE INVENTION

Figure 1:
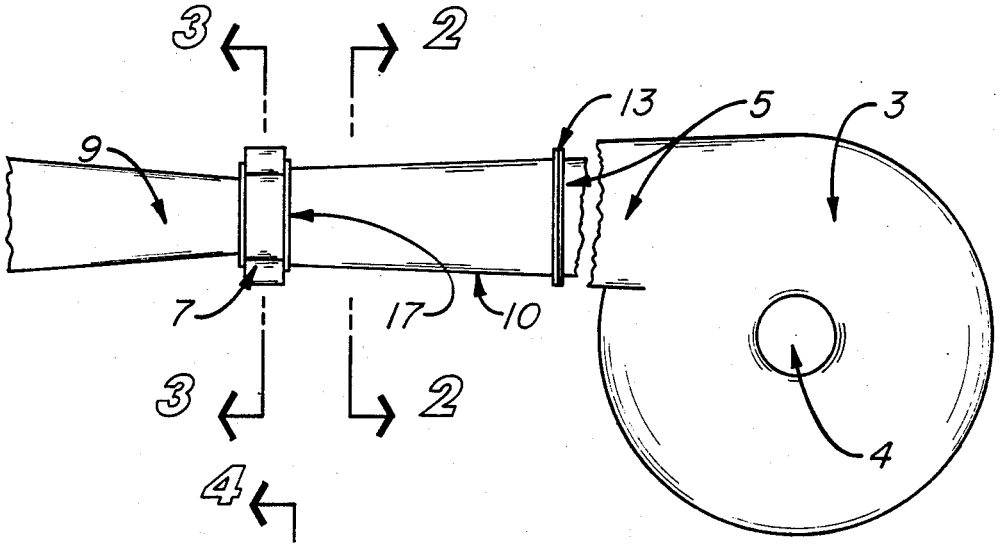
FIG. 1 is a side view of food cutting apparatus including the aligning and centering tube of the present invention.
Figure 2:
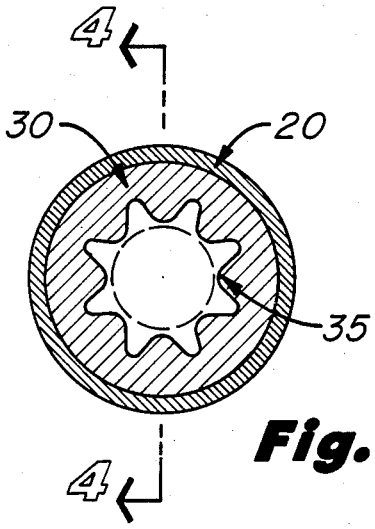
FIG. 2 is a cross-sectional view of the tube taken along lines 2—2 of FIG. 1.
Figure 3:
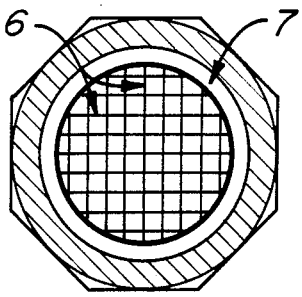
FIG. 3 is a cross-sectional view of the cutter taken along lines 3—3 of FIG. 1.
Figure 4:
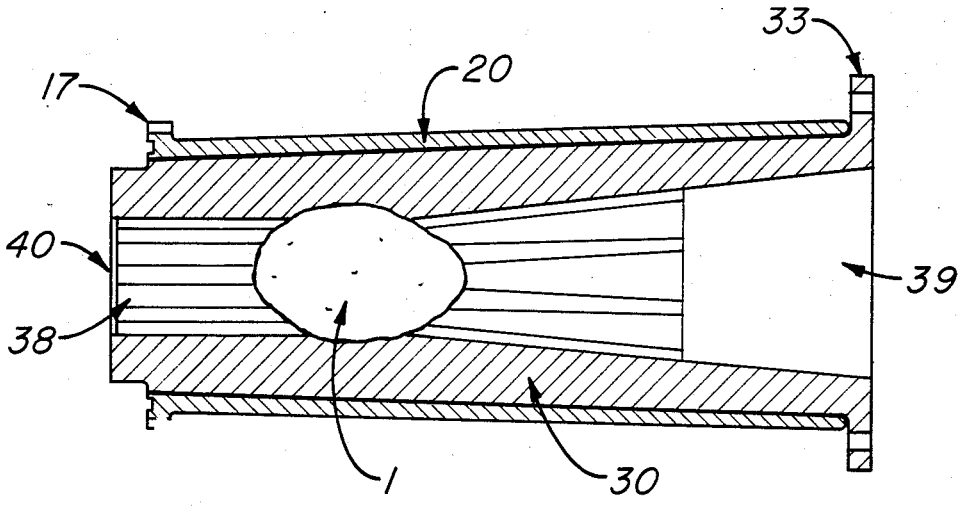
FIG. 4 is a partial horizontal section of the tube taken along lines 4—4 of FIG. 2 showing alignment and centering of a potato.

Referring now to the figures and in particular to FIGS. 1,2, and 4, a preferred embodiment of a food product centering and aligning tube 10 made in accordance with the present invention is disclosed. An hydraulic food cutting assembly is illustrated in FIG. 1, showing a pump 3 having an inlet 4 for the intake of the raw food product, such as potatoes. Pump 3 feeds the water and potatoes into a tapered tube 5 and then into tube 10 of the present invention where the potato is aligned and centered before entering the cutter 7 which cuts the potato into raw french fries, for example. From the cutter, the cut product and fluid is conveyed by tube 9 to a collector, not shown.

Tube 10 of the present invention is coupled to tapered tube 5 and and to cutter 7 by suitable couplings 13 and 17, respectively. Tube 10 includes a rigid tubular outer housing 20 and a tubular liner 30 insertable into the outer housing, the walls of the liner snugly engaging the smooth interior surface of the housing. Liner 30 is held tightly within the housing by frictional contact between the walls of the liner and housing as well as by annular flange 33 which engages coupling 13.

Outer housing 20 is constructed of rigid inelastic material with stainless steel being preferred for construction. While the housing may be of constant internal diameter for its entire length, it is preferred that housing 20, as well as the insertable liner 30, be tapered to define an inlet port having a greater diameter than the outlet port for reasons hereinafter explained. Such construction also assists in holding the liner in close contact with the housing. In providing an inflexible outer housing, with a tightly fitting liner, the system is insensitive to variations in the internal pressure of tube 10 and the configuration of the resilient liner is therefore unaltered by such variations.

Figure 6:
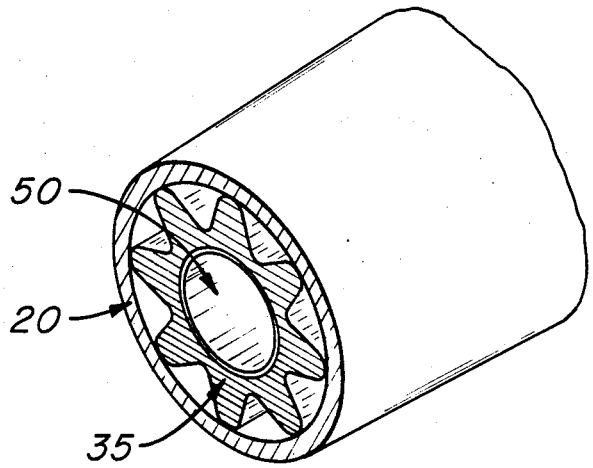
FIG. 6 is a partial perspective view of the tube showing the optional inner tube.

Liner 30 is made of resilient material, preferably in the nature of a polyurethane elastomer, it being preferred that all structural elements of the liner be integral with one another and therefore made of the same composition. Liner 30 may include a plurality of resilient ribs 35 which extend radially inward relative to the longitudinal axis of housing 20 and which extend longitudinally a selected distance within the housing as shown in FIGS. 2 and 4. The liner preferably includes a wall interconnecting the ribs and engaging the internal wall of housing 20, as shown in FIGS. 2 and 4, but may include ribs which themselves engage the internal walls of housing 20, the ribs being interconnected as by an intermediary wall or as by an inner lining, as shown in FIG. 6. The ribs are evenly spaced from one another about the internal periphery of the liner and extend inwardly toward one another a selected distance to define an uninterrupted opening along the length of the liner, the uninterrupted opening being indicated in FIG. 2 by the dotted line. It is also preferred that the ribs of the liner be tapered from or adjacent the inlet port 39 of the liner to or adjacent the outlet port 38 of the liner so as to define an uninterrupted opening at the outlet port which is of less diameter than the uninterrupted opening at the inlet port. In this manner, frictional losses in the system are significantly reduced in that the frictional contact between the potato and the ribs are minimized.

Figure 5:
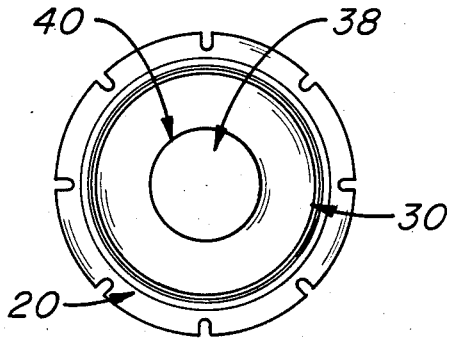
FIG. 5 is an end view of the outlet port of the tube showing the seal.

Located adjacent the outlet port 38 of liner 30 is an annular seal 40 transverse to the axis of the liner and the ribs, shown to advantage in FIGS. 4 and 5. If desired, additional seals upstream from seal 40 may be provided. Seal 40 is constructed of resilient material and defines a circular opening to allow passage of potatoes larger than the uninterrupted opening provided. Seal 40 sealingly engages the wall of liner 30 and any adjacent ribs. The opening in the seal is preferably of the same diameter as the uninterrupted opening defined by the ribs. Each seal is preferably integral with the liner wall and the ribs. The seal is preferably constructed of material such as a polyurethane elastomer. Seal 40, being adjacent cutter 7, causes the full force of water, the driving fluid, to bear upon the potato or other raw food product, thereby causing acceleration of the product as it engages blades 6 of cutter 7. Such acceleration results in cleaner cuts of the material and also results in superior efficiency of the cutting operation. The seal also restricts the amount of water passage resulting in greater pumping efficiency.

Referring now to FIG. 6, a resilient inner tube 50 is shown; the inner tube being an optional accessory. Inner tube 50 provides a lining extending between adjacent ribs for the length of the tube to define a tubular covering which is substantially the same in diameter as the uninterrupted opening at any particular location along the length of the tube, as shown by the dotted line in FIG. 2. Use of inner tube 50 provides greater contact with the food product for alignment may also result in frictional loss. The inner tube is preferably integral with liner 30 and ribs 35.

In operation, and assuming a centering and aligning tube 10 without the optional inner tube 50, potatoes 1 and driving fluid enter centering and aligning tube 10 from pump 3, as shown in FIGS. 1 and 4. Potatoes 1, varying in cross-sectional diameter and in overall size and shape, engage the innermost surfaces of ribs 35, ie. that portion of the ribs closest to the longitudinal axis of the liner, causing the ribs to flex to a degree dependent upon the pressure applied by the driven potato, resulting in the potato center-line being held in precise alignment with the center-line of the cutter 7. The ribs respond instantaneously to the variations in size and shape of the product to allow a larger potato than ordinary to pass immediately behind a small potato, assuring that both are held in precise alignment to the center-line of the cutter. Once the product engages resilient seal 40, the driven water can no longer escape through the longitudinal opening defined by the ribs and must exit through the opening defined by seal 40. The fluid pressure is therefore increased at this location causing rapid acceleration of the potato as it enters the cutter. The seal is of sufficient resiliency to allow products exceeding the normal diameter of the seal opening to pass through the opening.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. In hydraulic food product cutting apparatus including a food cutter, a food product centering and aligning tube comprising:

a rigid tubular housing, said housing fixed in immovable relationship relative to said food cutter, and a liner constructed of resilient material, said liner fixed in immovable relationship with respect to said housing and snugly engaging the interior surface of said housing for maintaining configuration of said liner and said liner having an inlet port and an outlet port, the inner surface of said liner operable to resiliently engage a food product for the centering and aligning thereof relative to the cutter.

2. In hydraulic food product cutting apparatus including a food cutter, a food product centering and aligning tube comprising:

a rigid tubular housing, said housing fixed in immovable relationship relative to said food cutter, and a resilient liner fixed in immovable relationship with respect to said housing and for insertion into said housing, said liner snugly engaging the interior surface of said housing for maintaining configuration of said liner, said liner having an inlet port and an outlet port and said liner provided with a plurality of resilient ribs engageable with said food product for centering and aligning said product relative to the cutter.

3. The tube as described in claim 2 wherein said ribs are radially extending toward the longitudinal axis of said housing.

4. The tube as described in claim 2 wherein said ribs extend longitudinally a selected distance within said liner.

5. The tube as described in claim 2 wherein said ribs are evenly spaced from one another about the inner periphery of said liner.

6. The tube as described in claim 2 further comprising an annular resilient seal engaging said liner adjacent the outlet of said liner, said seal provided with an opening substantially equal in diameter to the uninterrupted opening defined by said ribs for increasing fluid pressure within said liner.

7. The tube as described in claim 6 wherein said seal is integral with said liner.

8. The tube as described in claim 2 wherein said housing and said liner are longitudinally tapered having an inlet port of greater diameter than the outlet port.

9. The tube as described in claim 8 wherein said ribs of said liner are longitudinally tapered to define an uninterrupted opening at the liner inlet port greater in diameter than the uninterrupted opening at the liner outlet port.

10. The tube as described in claim 2 further comprising a resilient inner lining affixed to said ribs to define an inner tube supported by said ribs.

11. The tube as described in claim 10 wherein said inner tube is integral with said liner.

12. In hydraulic potato cutting apparatus including a cutter, a potato centering and aligning tube comprising:

a rigid tubular housing, said housing fixed in immovable relationship to said food cutter, and a liner insertable into and engaging the interior walls of said housing, said liner fixed in immovable relationship with respect to said housing and having an inlet port and an outlet port and said liner provided with a plurality of radially and longitudinally extending resilient ribs, said ribs engageable with potatoes traversing the liner for the aligning and centering of the potatoes relative to the cutter.

13. The tube as described in claim 12 wherein said ribs are evenly spaced from one another about the inner periphery of said liner.

14. The tube as described in claim 12 wherein said ribs are tapered from the inlet port of said liner to the outlet port of said liner.

15. The tube as described in claim 12 further comprising at least one seal, each seal transversely oriented relative to said liner and sealingly engaging the wall of the liner and said ribs, and each seal defining an aperture through which potatoes may pass, each of said seals operable to increase the fluid pressure within said liner.

16. The tube as described in claim 15 wherein each of said seals defines an aperture substantially the same size in diameter as the uninterrupted opening defined by the ribs adjacent the seal.

17. The tube as described in claim 12 further comprising a resilient inner tube affixed to said ribs.

18. In hydraulic potato cutting apparatus including a cutter, a potato centering and aligning tube comprising:

a rigid tubular housing, said housing fixed in immovable relationship relative to said food cutter, a liner insertable into and engaging the interior walls of said housing, said liner fixed in immovable relationship with respect to said housing and having an inlet port and an outlet port and said liner provided with a plurality of evenly spaced, radially inward and longitudinally extending resilient ribs, said ribs engageable with potatoes traversing the liner for the aligning and centering of the potatoes relative to the cutter; and at least one seal transversely and sealingly engaging said liner and said ribs adjacent the outlet port of said liner, each of said seals defining an aperture for the passage of potatoes therethrough for increasing the fluid pressure within said liner.

19. The tube as described in claim 18 wherein said seal defines an aperture substantially equal in diameter to the uninterrupted opening defined by said ribs.

20. The tube as described in claim 18 wherein said ribs are tapered to define an uninterrupted opening adjacent the outlet port of said liner which is of less diameter than the uninterrupted opening defined by said ribs elsewhere in the liner.

21. The tube as described in claim 18 further comprising a resilient inner tube affixed to said ribs.

* * * * *